United States Patent [19]

Moriarty et al.

[11] 4,121,982

[45] Oct. 24, 1978

[54] GOLD ALLOY PLATING BATH AND METHOD

[75] Inventors: William L. Moriarty, South Meriden; Augustus Fletcher, Bristol, both of Conn.

[73] Assignee: American Chemical & Refining Company Incorporated, Waterbury, Conn.

[21] Appl. No.: 874,893

[22] Filed: Feb. 3, 1978

[51] Int. Cl.[2] ..... C25D 3/62; C25D 3/64

[52] U.S. Cl. ..... 204/43 G; 204/43 R

[58] Field of Search ..... 204/43 R, 43 G, 123, 204/44; 106/1.14, 1.19

[56] References Cited

U.S. PATENT DOCUMENTS

| | | | |
|---|---|---|---|
| Re. 24,582 | 12/1958 | Rinker | 204/43 G |
| 2,800,439 | 7/1957 | Fischer et al. | 204/43 G |
| 2,967,135 | 1/1961 | Ostrow et al. | 204/43 G |
| 3,092,559 | 6/1963 | Foulke et al. | 204/43 G |
| 3,642,589 | 2/1972 | Nobel et al. | 204/44 |
| 3,666,640 | 5/1972 | Smith | 204/44 |
| 3,864,222 | 2/1975 | Wilson et al. | 204/43 G |
| 3,984,292 | 10/1976 | Culjkovic | 204/46 R |

*Primary Examiner*—G. L. Kaplan

[57] ABSTRACT

An aqueous bath for electroplating a gold/silver alloy includes a water soluble electrolyte such as potassium pyrophosphate, gold and silver present as their respective alkali metal cyanides, and a water soluble brightener system. The water soluble brightener system comprises a selenium compound containing selenium in the -2 valance state and a polyethyleneimine compound. The bath has a pH of about 8 to 10 and may include tetraethanolamine borate ester to decrease the tensile stress of the electrodeposit.

19 Claims, No Drawings

GOLD ALLOY PLATING BATH AND METHOD

BACKGROUND OF THE INVENTION

The present invention concerns an aqueous bath composition for electrolytic deposition of gold/silver alloys. Numerous such compositions are, of course, known in the art. It is also generally known in the art that certain additives may be included in a bath composition which have a brightening effect on the deposited electroplate metal.

For example, U.S. Pat. No. 3,864,222 issued Feb. 4, 1975, to William A. Wilson et al discloses the use of polyethyleneimines as an additive to gold and gold alloy plating baths as agents for general improvement of the brightness of the electroplated metal. The polyethyleneimines are added in the amounts of 0.005 to 100 grams per liter and have a molecular weight in the range 100 to 60,000.

U.S. Pat. No. 3,984,292 discloses a bath for the electrodeposition of silver from an aqueous cyanide-free bath including the use of organic nitrogen containing compounds, including polyethyleneimine, and a compound of sulfur or selenium in which the sulfur or selenium is in an oxidation state of −1 or −2.

It has now been found that in a gold/silver alloy low or no free cyanide plating bath, polyethyleneimine brightener tends to retard the electrodeposition of gold more than that of silver, with the result that employment of polyethyleneimine favors deposition of silver over gold and provides a lower karat deposit. It has further been found that satisfactory brightening of a gold/silver alloy is attained notwithstanding a reduction of the amount of polyethyleneimine employed when selenium in the −2 valance state is combined with the polyethyleneimine. It is accordingly an object of the present invention to provide a novel gold/silver alloy plating bath which enhances brightening of the electroplated metal alloy without adversely affecting the radio of gold to silver plated, and thereby the karat of the finished electroplate.

It is another object of the present invention to provide a novel bath composition for the electroplating of gold/silver alloys which is simple and stable under plating conditions and in which a synergistic brightening and karat stabilizing effect is attained by utilization of a brightening additive comprising a water soluble compound of selenium in the −2 valance state and a water soluble polyethyleneimine compound.

It is another object of the present invention to provide a novel bath composition for electroplating gold/silver alloys which provides a reduction of tensile stress in the electroplated alloy.

SUMMARY OF THE INVENTION

In accordance with the present invention there is provided, in a bath for electroplating a gold/silver alloy, the following combination in an aqueous solution. At least one water soluble electrolyte selected from the class consisting of alkali metal salts of boric acid, of citric acid, of phosphoric acid, of pyrophosphoric acid and of tartaric acid, the electrolyte being present in a quantity at least sufficient to render the bath electrically conductive for electroplating gold and silver from it. Gold ion is provided by an alkali metal gold cyanide, the gold being present in an amount from 1 gram per liter up to that provided by saturation of the bath with the alkali metal gold cyanide. Silver ion is provided by an alkali metal silver cyanide, the silver being pressent in an amount from ½ gram per liter up to that provided by saturation of the bath with the alkali metal silver cyanide. A water soluble brightener system comprises selenium ion provided by a water soluble selenium compound containing selenium in the −2 oxidation state and a water soluble ethyleneimine compound. The selenium ion is present in the amount of about 0.1 to 0.5 ppm selenium for each gram per liter of silver ion, and the ethyleneimine compound is present in the amount of about 4 to 75 ppm ethyleneimine compound for each gram per liter of gold ion. The bath has a pH of about 8 to 10.

The ethyleneimine compound is preferably polyethyleneimine but may be monomeric ethyleneimine, a substituted ethyleneimine or the reaction product of ethyleneimine and an organic or inorganic molecule.

In accordance with one aspect of the invention, the ethyleneimine compound may be polyethyleneimine and the selenium may be present in the amount of about 0.125 to 0.333 ppm for each gram per liter of silver ion, and the polyethyleneimine is present in the amount of about 8 to 36 ppm for each gram per liter of gold ion. In another aspect of the invention, the gold ion is present in the amount of about 1.5 to 50 grams per liter and the silver ion is present in the amount of about 1.0 to 26 grams per liter.

The pH of the bath may be adjusted with one or more of a pH adjusting component selected from sulfuric acid, phosphoric acid, pyrophosphoric acid and potassium hydroxide. Preferably, a pH of about 8.5 is maintained and a pH buffer such as boric acid may be employed.

Certain objects of the invention are attained when the bath for electroplating a gold/silver alloy comprises an aqueous solution of the following combination of ingredients. About 10 to 600 grams per liter of at least one of a water soluble electrolyte selected from the class consisting of alkali metal salts of: boric acid, citric acid, phosphoric acid, pyrophosphoric acid and tartaric acid, up to about 140 grams per liter of tetraethanolamineborate ester, about 1.5 to 50 grams per liter of gold ion provided by an alkali metal gold cyanide, and about 1 to 25 grams per liter of silver ion provided by an alkali metal silver cyanide. A water soluble brightener system is included which comprises about 0.125 to 8 ppm of selenium provided by a water soluble compound containing selenium in the −2 oxidation state, and about 12 to 1800 ppm of polyethyleneimine. The bath has a pH of about 8 to 10. Preferably, a ratio of about 0.125 to 0.333 ppm of selenium ion for each gram per liter of silver and a ratio of about 8 to 36 ppm for each gram of gold ion is maintained.

A preferred embodiment of the invention is provided when the electrolyte is an alkali metal phosphate or alkali metal pyrophosphate, most preferably tetrapotassium pyrophosphate. The alkali metal gold cyanide and alkali metal silver cyanide are preferably potassium gold cyanide and potassium silver cyanide. The selenium compound is preferably potassium selenocyanate. Tetraethanolamineborate ester may be included as a stress reducer.

One aspect of the invention provides, in the method of electroplating gold/silver deposits upon a workpiece, the steps of immersing a workpiece having an electrically conductive surface into an aqueous bath of the invention as described above, and maintaining the temperature of the bath at 26°–44° C. An electrical potential is applied across the workpiece and an anode inert to the bath, the potential providing a current density of about 6 to 18 amperes per square foot and removing the plated workpiece from the bath.

DETAILED DESCRIPTION OF THE PREFERRED EMBODIMENTS

As indicated above, the compositions of the present invention essentially comprise an aqueous solution containing an electrolyte, gold and silver ions provided by their respective alkali metal cyanides, and a water soluble brightener system comprising a selenium (−2) compound and an ethyleneimine compound. The ethyleneimine compound is preferably polyethyleneimine of 600 to 60,000, more preferably 600 to 1200 average molecular weight.

Referring first to the electrolyte, generally any water soluble material which provides the requisite degree of electrical conductivity to the bath is compatible with the other components, and does not unduly interfere with or adversely affect the quantity or quality of electroplated alloy is suitable. It has been found that alkali metal salts of certain weak acids are particularly suitable, more specifically, alkali metal borates, alkali metal citrates, alkali metal phosphates, alkali metal pyrophosphates, and alkali metal tartrates or mixtures thereof provide a suitable electrolyte.

Potassium pyrophosphate ($K_4P_2O_7$) has been found to be a particularly suitable electrolyte and a useful and stable bath has been obtained when it is employed. Preferably, the potassium pyrophosphate is present in an amount between about 37.5 to 150 grams of potassium pyrophosphate (anhydrous basis) per liter of bath solution. Accordingly, potassium pyrophosphate is the preferred electrolyte although the others identified may also be employed.

Both gold and silver ions must, of course, be present in a form in which they can be electroplated onto the workpiece to be plated. It has been found that both gold and silver ions may be introduced into the bath as their respective alkali metal cyanides. That is, it has been found that the gold may be introduced into the bath solution as alkali metal gold cyanide and the silver may be introduced as alkali metal silver cyanide. A particularly effective bath in accordance with the invention is found to be provided when the bath contains between about 6 to 12.5 grams per liter of gold introduced as potassium gold cyanide and between 4 to 6.5 grams of silver per liter introduced as potassium silver cyanide.

The brightener system essentially contains two components, one being a water soluble selenium compound which provides selenium in solution in the −2 valance state, and the other being a water soluble polyethyleneimine.

The selenium-providing compound is preferably provided by potassium selenocyanate (KSeCN). Potassium selenocyanate may be prepared by the addition of potassium cyanide to an aqueous solution containing selenium ion, such as that provided by a solution of potassium selenide. Potassium selenocyanate is available commercially, for example, from Ventron Corporation.

Polyethyleneimine is a water soluble cationic polymer which is commercially available from the Dow Chamical Company. It is a highly branched polymer produced by polymerization of the monomer ethyleneimine. The polymer is available commercially in several different ranges of average molecular weight. These include polyethyleneimine sold by the Dow Chemical Company as PEI-6, which has an average molecular weight of about 600 PEI-12 which has an average molecular weight of about 1200 and PEI 600 which has an average molecular weight of about 60,000. Polyethyleneimine may be produced by several methods as is known in the art. See, for example, a work entitled *Ethyleneimine and Other Azardines* by O. C. Dermer and G. E. Ham.

A successful bath composition has been obtained when polyethyleneimine is present in amounts of about 50 to 450 parts per million by weight (ppm) polethyleneimine in the bath solution. Hereinafter, and in the claims, the abbreviation "ppm" shall be used to mean parts per million by weight. This amount of polyethyleneimine, when combined with between about 0.5 to 2.0 ppm of selenium ion in the −2 oxidation state, has been found to provide an efficacious brightener for gold/silver alloy which does not affect adversely the ratio of deposited gold and silver.

A test solution was made up in accordance with Example 2, below, except that the amount of polyethyleneimine was varied, and the silver was omitted, as shown in the following table, and test samples were electroplated under identical condition

TABLE

| | Composition of Example 2, except that polyethyleneimine content is as follows: | | |
|---|---|---|---|
| Amount | % of Example 2 Amount | Metal Deposition Rate | Metal Appearance |
| 0 | 0 | 105.9 mg/amp-min. | Cloudy |
| 75 ppm | 50% | 38.8 mg/amp-min. | Bright |
| 150 ppm | 100% | 39.2 mg/amp-min. | Bright |
| 225 ppm | 150% | 33.3 mg/amp-min. | Bright |
| 300 ppm | 200% | 34.4 mg/amp-min. | |

The above tests were repeated with identical composition as those of the TABLE except that gold was omitted. Varying the polyethyleneimine content did not appreciably affect the metal deposition rate in the absence of gold. These tests thus verify that polyethyleneimine has an adverse effect on the deposition rate of gold, but not that of silver and that its presence is necessary to attain satisfactory brightness and karat of the gold/silver electroplate.

Generally, it has been found that when polyethyleneimine is employed in amounts large enough to have a brightening effect, it significantly retards the rate of electrodeposition of gold as compared to that of silver. Consequently, when a gold alloy bath composition is prepared with a preselected ratio of gold to silver in the expectation of obtaining a selected proportion of gold to silver in the alloy, i.e., to obtain a plate of selected karat, the pressence of polyethyleneimine in brightening amounts was found to retard the deposition rate of gold relative to that of silver, resulting in a lower karat, lighter color alloy than that desired. Reduction of the proportion of polyethyleneimine to a level below that which would unduly adversely affect the deposition rate of gold was found to provide unsatisfactory brightness of the gold/silver alloy electroplate. However, the combination, with the specified quantity of polyethyleneimine, of the specified selenium compound in an amount sufficient to provide between about 0.5 to 2.0 ppm, of selenium in the bath is found to have the synergistic effect of providing an entirely acceptable brightness to the electroplate without adversely affecting the gold to silver ratio of the deposited alloy.

Although not essential in accordance with the practice of the invention, it has been found desirable to include a proportion of tetraethanolamineborate ester in the bath composition to reduce the tensile stress of the electrodeposit.

The tetraethanolamineborate is obtained by mixing tetraethanolamine with boric acid; the reactants react to form the borate ester. Generally, the adhesion strength of an electroplated layer is a factor not only of the bath composition but of the bath plating conditions, the nature and preparation of the metal workpiece on which the electroplate is deposited, etc. Other conditions being equal, the addition of a quantity of tetraethanolamineborate, preferably up to about 37.5 grams of the ester per liter of bath composition, has been found to reduce the tensile stress and therefor enhance adhesion of the electroplate. For example, under difficult plating conditions, addition of the tetraethanolamine ester was found to overcome any tendency of exfoliation of the deposited electroplate alloy.

The pH of the bath should be maintained between a value of about 8 to 10. At a pH below about 8, the stability of potassium of silver cyanide and potassium gold cyanide begins to be adversely affected. For example, potassium silver cyanide is unstable at a pH of 6.5 or below and the bath composition decomposes. On the other hand, at a pH of above 10, the alkaline conditions permit excessive build-up of free cyanide in the bath solution which has a chelating effect on the gold and silver metal and interface with proper plating.

The bath composition pH may be adjusted with phosphoric acid or pyrophosphoric acid ($H_3PO_4$ or $H_4P_2O_7$) to reduce the pH, or with an alkali metal hydroxide, preferably potassium hydroxide (KOH), to increase the pH, as necessary.

During electroplating, the bath composition it maintained preferably at a temperature of between about 26° C. to 43° C. (80° to 110° F.), most preferably about 32° C. (90° F.). The current density is preferably between about 6 to 18 amperes per square foot, most preferably about 12 amperes per square foot. Rack plating is preferably employed to permit better control of current density. Agitation of the bath during plating is desirable and the employment of filtering, as is known to those skilled in the art, is also desirable to remove solid contaminants formed in or inadvertently introduced into the bath composition. Generally, conventional noble metal clad anodes employed for the electroplating of gold and gold/silver alloys are suitable in use with the bath compositon of the invention. Conventional platinum clad anodes of tantalum, columbium or titanium are readily usable with the composition of the invention, as are conventional tanks, pumps, filters, etc.

It has been found that the gold/silver alloy deposits produced by the invention are bright, strongly adherent to the base metal or workpiece, and the karat, that is, the gold content, closely conforms to that corresponding to the ratio of one half gold to silver ratio provided in the bath. The various components of the bath of the invention may be replenished during operation, as is conventional practice.

The following specific examples are exemplary of bath compositions in accordance with the present invention. It will be understood that these examples are merely illustrative of specific embodiments. It will be further understood that in use impurities, reaction products, etc. will accumulate or be introduced into the composition in minor amounts.

EXAMPLE 1

An aqueous gold/silver alloy plating bath of 8.5 pH* designed to provide a 12 karat electroplate has the following composition:

| Component | Amount |
|---|---|
| Tetrapotassium phosphate | 75.0 g/l |
| Gold ion, provided by $KAu(CN)_2$ | 8.2 g/l |
| Silver ion, provided by $KAg(CN)_2$ | 4.1 g/l |
| Selenium(−2) ion, provided by KSeCN | 1 ppm |
| Polyethyleneimine of average molecular weight 600** | 150 ppm |

*Sufficient phosphoric acid or pyrophosphoric acid or potassium hydroxide is included to adjust the pH.

**Polyethyleneimine of average molecular weight 1200 may be substituted for all or part of the 600 molecular weight type.

EXAMPLE 2

The composition of Example 1, further including:

| Component | Amount |
|---|---|
| Boric Acid | 15 g/l |
| Tetraethanolamineborate ester | 7.5 g/l |

Examples 1 and 2 illustrate preferred embodiments of the invention. Example 3 illustrates a preferred range of bath compositions in accordance with the invention:

EXAMPLE 3

| Component | Amount |
|---|---|
| Tetrapotassium phosphate | 37 to 150 g/l |
| Boric Acid | 0 - 38 g/l |
| Gold ion, provided by $KAu(CN)_2$ | 6 - 12.5 g/l |
| Silver ion, provided by $KAg(CN)_2$ | 2 - 6.5 g/l |
| Selenium (−2) ion, provided by KSeCN | 0.5 - 2 ppm |
| Polyethyleneimine of average molecular weight 600 to 60,000 | 50 - 450 ppm |
| Pyrophosphoric acid | * |
| Potassium hydroxide | * |

*As required, to maintain the bath at a pH from about 8 to 10.

As indicated hereinabove, other electrolyte may be employed as well as other sources of selenium ion in the −2 oxidation state. Similarly, other acids or bases may be employed to adjust the path pH. For example, even sulfuric acid may be employed for pH adjustment because the small quantities required do not appear to adversely affect the results obtained. Further, it will be recognized by those skilled in the art that, in addition to reaction and breakdown products formed in the bath, certain impurities may exist in the bath and are tolerable in low concentrations. Specific tolerable concentrations of impurities depend to a certain extent on the plating conditions and the specifications which the finished work must meet. Generally, metal ions such as iron, magnesium, calcium, sodium, copper and nickel will be introduced into the bath as impurities in the ingredients used or by the contamination by the equipment or workpieces.

The composition of Example 2 was employed to plate watch bezels made of leaded brass. The bezels were cleaned and activated, and a copper strike, a bright nickle plate and a gold strike were then applied. The copper strike was 2–4 microinches thick, the nickel plate was 400–500 microinches thick, and the gold strike was 2–4 microinches thick. The gold/silver alloy provided by a bath in accordance with Example 2, above, was then applied to a thickness of 40 microinches. This was carried out by immersing the watch bezels in the bath and applying a potential across the benzels and an anode inert to the bath to provide a current at a density of about 12 amperes per square foot. The bath was maintained at a temperature of about 32° C. Thereafter, the workpiece was removed from the bath and a finish coat of 22K gold was applied to a thickness of 40 microinches. A bright, hard finish was obtained, including a bright, hard and adherent gold undercoat provided by the embodiment bath of the bath of the invention.

What is claimed is:

1. In a bath for electroplating a gold/silver alloy, the combination comprising an aqueous solution of:

(a) at least one water soluble electrolyte selected from the class consisting of alkali metal salts of boric acid, citric acid, phosphoric acid, pyrophosphoric acid and tartaric acid present in a quantity at least sufficient to render the bath electrically conductive for electroplating gold and silver therefrom;

(b) gold ion provided by an alkali metal gold cyanide, said gold being present in an amount from 1 gram per liter up to that provided by saturation of said bath with said alkali metal gold cyanide; and (c) silver ion provided by an alkali metal silver cyanide, said silver being present in an amount from ½ gram per liter up to that provided by saturation of said bath with said alkali metal silver cyanide; and (d) a water soluble brightener system comprising selenium ion provided by a water soluble selenium compound containing selenium in the −2 oxidation state and a water soluble ethyleneimine compound, said selenium ion being present in the amount of about 0.1 to 0.5 ppm selenium for each gram per liter of silver ion, and said ethyleneimine compound being present in the amount of about 4 to 75 ppm ethyleneimine compound for each gram per liter of gold ion;

said bath having a pH of about 8 to 10.

2. The bath of claim 1 wherein said ethyleneimine compound is polyethyleneimine.

3. The bath of claim 2 wherein said selenium is present in the amount of about 0.125 to 0.333 ppm for each gram per liter of silver ion, and said polyethyleneimine is present in the amount of about 8 to 36 ppm for each gram per liter of gold ion.

4. The bath of claim 3 wherein said gold ion is present in the amount of about 1.5 to 50 grams per liter and said silver ion is present in the amount of about 1.0 to 26 grams per liter.

5. In a bath for electroplating a gold/silver alloy, the combination comprising an aqueous solution of:

(a) about 10 to 600 grams per liter of at least one of a water soluble electrolyte selected from the class consisting of alkali metal salts of: boric acid, citric acid, phosphoric acid, pyrophosphoric acid and tartaric acid;

(b) 0 to about 140 grams per liter of tetraethanolamineborate ester;

(c) about 1.5 to 50 grams per liter of gold ion provided by an alkali metal gold cyanide;

(d) about 1 to 26 grams per liter of silver ion provided by an alkali metal silver cyanide; and (e) a water soluble brightener system comprising about 0.125 to 8 ppm of selenium provided by a water soluble compound containing selenium in the −2 oxidation state, and about 12 to 1800 ppm of polyethyleneimine, said polyethyleneimine being present in the amount of about 8 to 36 ppm for each gram of gold ion;

said bath having a pH of about 8 to 10.

6. The bath of claim 5 wherein said selenium is present in the amount of about 0.125 to 0.333 ppm for each gram per liter of silver ion.

7. In a bath for electroplating a gold/silver alloy, the combination comprising an aqueous solution of:

(a) about 37.5 to 150 grams per liter of at least one of a water soluble electrolyte selected from the class consisting of alkali metal salts of: boric acid, citric acid, phosphoric acid, pyrophosphoric acid and tartaric acid;

(b) up to about 37.5 grams per liter of tetraethanolamineborate ester;

(c) about 6 to 12.5 grams per liter of gold ion provided by an alkali metal gold cyanide;

(d) about 4 to 6.5 grams per liter of silver ion provided by an alkali metal silver cyanide; and (e) a water soluble brightener system comprising about 0.5 to 2 ppm of selenium provided by a water soluble compound containing selenium in the −2 oxidation state, and about 50 to 450 ppm of polyethyleneimine, said bath having a pH of about 8 to 10.

8. The bath of claim 7 wherein said polyethyleneimine has an average molecular weight of about 600 to 60,000.

9. The bath of claim 7 further including about 15 to 38 grams per liter of boric acid as a pH buffer.

10. The bath of claim 7 including at least one of a pH adjusting component selected from the class consisting of sulfuric acid, phosphoric acid, pyrophosphoric acid and potassium hydroxide.

11. The bath of claim 7 wherein said electrolyte is one of an alkali metal pyrophosphate and an alkali metal phosphate, said alkali metal gold cyanide is potassium gold cyanide, said alkali metal silver cyanide is potassium silver cyanide, and said selenium compound is potassium selenocyanate.

12. The bath of claim 4 wherein said electrolyte is tetrapotassium pyrophosphate.

13. In the method of electroplating gold/silver deposits upon a workpiece, the steps comprising:

A. immersing a workpiece having an electrically conductive surface into an aqueous bath having a pH of about 8 to 10 and comprising:

(1) at least one water soluble electrolyte selected from the class consisting of alkali metal salts of boric acid, citric acid, phosphoric acid, pyrophosphoric acid and tartaric acid present in a quantity at least sufficient to render the bath electrically conductive for electroplating gold and silver therefrom;

(2) gold ion provided by an alkali metal gold cyanide, said gold being present in an amount from 1 gram per liter up to that provided by saturation of said bath with said alkali metal gold cyanide;

(3) silver ion provided by an alkali metal silver cyanide, said silver being present in an amount from ½ gram per liter up to that provided by saturation of said bath with said alkali metal silver cyanide; and (4) a water soluble brightener system comprising selenium ion provided by a water soluble selenium compound containing selenium in the −2 oxidation state and a water soluble ethyleneimine compound, said selenium ion being present in the amount of about 0.1 to 0.5 ppm selenium for each gram per liter of silver ion, and said ethyleneimine compound being present in the amount of about 4 to 75 ppm ethyleneimine compound for each gram per liter of gold ion;

B. maintaining the temperature of said bath at 26°–44° C.;

C. applying an electrical potential across said workpiece and an anode inert to said bath, said potential providing a current density of about 6–18 amperes per square foot; and D. removing the electroplated workpiece from said bath.

14. The method of claim 13 wherein said selenium is present in the amount of about 0.125 to 0.333 ppm for each gram of silver ion, and said polyethyleneimine is present in the amount of about 8 to 36 ppm for each gram of gold ion.

15. The method of claim 14 wherein said gold ion is present in the amount of about 1.5 to 50 grams per liter and said silver ion is present in the amount of about 1.0 to 26 grams per liter.

16. The method of claim 13 wherein said electrolyte is one of an alkali metal pyrophosphate and alkali metal phosphate, said alkali metal gold cyanide is potassium gold cyanide, said alkali metal silver cyanide is potassium silver cyanide and said selenium compound is potassium selenocyanate.

17. The method of claim 13 wherein said bath further includes tetraethanolamineborate ester.

18. In the method of electroplating gold/silver deposits upon a workpiece, the steps comprising:

A. immersing a workpiece having an electrically conductive surface into an aqueous bath having a pH of about 8 to 10 and comprising:

(1) about 37.5 to 150 grams per liter of at least one of a water soluble electrolyte selected from the class consisting of alkali metal salts of: boric acid, citric acid, phosphoric acid, pryophosphoric acid and tartaric acid;

(2) up to about 37.5 grams per liter of tetraethanolamineborate ester;

(3) about 6 to 12.5 grams per liter of gold ion provided by an alkali metal gold cyanide;

(4) about 4 to 6.5 grams per liter of silver ion provided by an alkali metal silver cyanide; and (5) a water soluble brightener system comprising about 0.5 to 2 ppm of selenium provided by a water soluble compound containing selenium in the −2 oxidation state, and about 50 to 450 ppm of polyethyleneimine;

B. maintaining the temperature of said bath at 26°–44° C.;

C. applying an electrical potential across said workpiece and an anode inert to said bath, said potential providing a current density of about 6–18 amperes per square foot; and D. removing the electroplated workpiece from said bath.

19. The method of claim 18 wherein said electrolyte is one of an alkali metal pyrophosphate and an alkali metal phosphate, said alkali metal gold cyanide is potassium gold cyanide, said alkali metal silver cyanide is potassium silver cyanide, and said selenium compound is potassium selenocyanate.

* * * * *

UNITED STATES PATENT AND TRADEMARK OFFICE

CERTIFICATE OF CORRECTION

PATENT NO. : 4,121,982

DATED : October 24, 1978

INVENTOR(S) : William L. Moriarty et al

It is certified that error appears in the above-identified patent and that said Letters Patent are hereby corrected as shown below:

Column 8, line 41 "Claim 4" should be "Claim 11"

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*